US006183079B1

(12) United States Patent
Meade et al.

(10) Patent No.: US 6,183,079 B1
(45) Date of Patent: Feb. 6, 2001

(54) COATING APPARATUS FOR USE IN AN INK JET PRINTER

(75) Inventors: Alexander Douglas Meade; Michael Wesley Baskette; David Clay Blaine; Jeffrey Lynn Richie; Philip Jerome Heink, all of Lexington; Michael Craig Leemhuis, Nicholasville; David Starling MacMillan, Winchester; Mark Stephen Weisman, Jr., Lexington; Bradley Leonard Beach, Lexington; Peter Eric Wallin, Lexington; Ronald Willard Baker, Versailles, all of KY (US)

(73) Assignee: Lexmark International, Inc., Lexington, KY (US)

( * ) Notice: Under 35 U.S.C. 154(b), the term of this patent shall be extended for 0 days.

(21) Appl. No.: 09/096,306

(22) Filed: Jun. 11, 1998

(51) Int. Cl.[7] ..... B41J 2/01

(52) U.S. Cl. ..... 347/101; 346/135.1; 118/46

(58) Field of Search ..... 347/101, 104, 347/107, 106, 2, 4; 101/489, 425; 428/198; 346/135.1; 118/46

(56) References Cited

U.S. PATENT DOCUMENTS

| | | | |
|---|---|---|---|
| 2,288,720 | | 7/1942 | Knowlton . |
| 3,222,209 | | 12/1965 | Brundige et al. . |
| 3,301,156 | | 1/1967 | Roeber . |
| 3,499,419 | | 3/1970 | Bohmer et al. . |
| 3,885,066 | | 5/1975 | Schwenninger . |
| 4,141,317 | | 2/1979 | Lakhani . |
| 4,161,141 | | 7/1979 | Lakhani . |
| 4,165,686 | | 8/1979 | Borelli et al. . |
| 4,270,859 | | 6/1981 | Galbraith et al. . |
| 4,354,851 | | 10/1982 | Hix et al. . |
| 4,382,262 | | 5/1983 | Savit . |
| 4,478,505 | | 10/1984 | Tashiro . |
| 4,503,802 | | 3/1985 | Keller et al. . |
| 4,521,785 | | 6/1985 | Matsufuji . |
| 4,538,906 | | 9/1985 | Brown . |
| 4,599,627 | | 7/1986 | Vollert . |
| 4,685,414 | | 8/1987 | DiRico . |
| 4,702,742 | | 10/1987 | Iwata et al. . |
| 4,704,615 | | 11/1987 | Tanaka . |
| 4,721,968 | * | 1/1988 | Aral et al. ..... 347/105 |
| 4,738,879 | | 4/1988 | Williams . |
| 4,766,840 | | 8/1988 | Beckley et al. . |
| 4,786,288 | | 11/1988 | Handa et al. . |
| 4,839,200 | | 6/1989 | Hoffman et al. . |
| 4,949,667 | * | 8/1990 | Yoshida et al. ..... 118/60 |
| 5,006,862 | | 4/1991 | Adamic . |
| 5,045,888 | | 9/1991 | Imaeda . |
| 5,075,153 | | 12/1991 | Malhotra . |
| 5,085,171 | | 2/1992 | Aulick et al. . |
| 5,107,788 | | 4/1992 | Boldrini et al. . |

(List continued on next page.)

FOREIGN PATENT DOCUMENTS

| | | | |
|---|---|---|---|
| 0 778 321 A2 | | 6/1977 | (EP) . |
| 0 726 156 A10 | | 8/1996 | (EP) . |
| 0 822 094 A2 | | 2/1998 | (EP) . |
| 361074876 | * | 4/1986 | (JP) . |
| 63-299971 | | 12/1988 | (JP) . |
| 406255097 | * | 9/1994 | (JP) . |
| 4062555096 | * | 9/1994 | (JP) ..... 347/101 |
| 406270397 | * | 9/1994 | (JP) ..... 347/101 |

*Primary Examiner*—Eugene Eickholt
(74) *Attorney, Agent, or Firm*—D. Brent Lambert

(57) ABSTRACT

An ink jet printer is provided comprising a housing, an ink jet printing apparatus and a coating apparatus. The ink jet printing apparatus is located within the housing and includes an ink jet printing device capable of ejecting ink droplets onto a first side of a printing substrate which moves through the housing along a printing substrate feed path. The coating apparatus is positioned along the printing substrate feed path and spaced from the printing device. The coating apparatus applies a substantially uniform layer of coating material onto at least a portion of the first side of the printing substrate.

10 Claims, 3 Drawing Sheets

U.S. PATENT DOCUMENTS 5,116,148 5/1992 Ohara et al. .
5,117,768 6/1992 Seymour .
5,132,706 * 7/1992 Yuasa et al. ..... 101/489
5,141,599 8/1992 Jahn et al. .
5,178,678 1/1993 Koehler et al. .
5,220,346 6/1993 Carreira et al. .
5,230,926 7/1993 Narang et al. .
5,255,023 10/1993 Bowlby, Jr. et al. .
5,305,020 4/1994 Gibbons et al. .
5,315,322 5/1994 Bannai .
5,337,032 8/1994 Baker et al. .
5,372,852 12/1994 Titterington et al. .
5,396,275 3/1995 Koike et al. .
5,403,358 4/1995 Aston et al. .
5,406,356 4/1995 Campbell et al. .
5,440,329 8/1995 Meggitt et al. .
5,445,463 8/1995 Paranipe .
5,455,604 10/1995 Adams et al. .
5,462,787 10/1995 Yamamoto et al. .
5,500,668 3/1996 Malhotra et al. .
5,500,724 3/1996 Campbell et al. .
5,512,930 4/1996 Brandt et al. .
5,521,002 * 5/1996 Sneed ..... 428/195
5,523,122 6/1996 Harada et al. .
5,546,114 8/1996 Tait et al. .
5,552,819 9/1996 Brandt et al. .
5,561,454 10/1996 Kurabayashi et al. .
5,563,644 10/1996 Isganitis et al. .
5,589,869 12/1996 Brandt et al. .
5,614,933 3/1997 Hindman et al. .
5,618,338 4/1997 Kurabayashi et al. .
5,619,240 * 4/1997 Pong et al. ..... 347/4
5,623,294 4/1997 Takizawa et al. .
5,623,718 4/1997 Bracken et al. .
5,628,827 5/1997 McCollam et al. .
5,633,045 5/1997 Smith et al. .
5,635,969 6/1997 Allen .
5,645,888 7/1997 Titterington et al. .
5,651,620 7/1997 Paranipe .
5,677,067 * 10/1997 Kojima et al. ..... 428/195
5,678,133 10/1997 Siegel .
5,681,643 10/1997 Noguchi et al. .
5,688,603 11/1997 Iqbal et al. .
5,695,820 12/1997 Davis et al. .
5,702,812 12/1997 Bracken et al. .
5,708,943 1/1998 Applegate et al. .
5,712,027 1/1998 Ali et al. .
5,797,318 8/1998 Taylor et al. .
5,808,645 9/1998 Reeves et al. .
5,825,378 10/1998 Beauchamp .
5,827,577 * 10/1998 Spencer ..... 101/450.1
5,882,131 * 3/1999 Belon et al. ..... 400/662
5,908,505 6/1999 Bargenquest et al. .
5,993,524 11/1999 Nagai et al. .

* cited by examiner

COATING APPARATUS FOR USE IN AN INK JET PRINTER

CROSS-REFERENCE TO RELATED APPLICATION

This application is related to contemporaneously filed patent application U.S. Ser. No. 09/096,128, entitled "COATING SYSTEM FOR INK JET APPLICATIONS," the disclosure of which is incorporated herein by reference.

FIELD OF THE INVENTION

This invention relates to an ink jet printer having a coating apparatus positioned along a printing substrate feed path and spaced from an ink jet printing device.

BACKGROUND OF THE INVENTION

Drop-on-demand ink jet printers use thermal energy to produce a vapor bubble in an ink-filled chamber to expel a droplet. A thermal energy generator or heating element, usually a resistor, is located in the chamber on a heater chip near a discharge nozzle. A plurality of chambers, each provided with a single heating element, are provided in the printer's printhead. The printhead typically comprises the heater chip and a nozzle plate having a plurality of the discharge nozzles formed therein. The printhead forms part of an ink jet print cartridge which also comprises an ink-filled container.

Ink jet printers have typically suffered from two major shortcomings. First, optical density of a printed image varies greatly with the print media or substrate being printed upon. Second, ink drying time is excessive.

Attempts to solve these problems through ink formulation have resulted in a loss of performance in other areas, and in general any change made to solve one of the two problems has resulted in aggravation of the other problem.

Heating stations positioned before, coincident with and after the print zone can improve optical density and drying time, but at the expense of power consumption and machine complexity. Hence, this solution has not been found desirable.

Accordingly, there is a need for an improved ink jet printer which is capable of printing images uniformly well on a wide variety of commercially available substrates and wherein ink drying time is minimized.

SUMMARY OF THE INVENTION

This need is met by the present invention wherein an ink jet printer is provided having a coating apparatus for applying a thin layer of liquid coating material onto at least a portion of a first side of a substrate. Preferably, the coating apparatus is positioned before the ink jet printing device. It is also preferred that the coating material have a high viscosity such that only a minimum amount of water is introduced onto the substrate. Typically, the functionality of the coating material is not diminished by the addition of water to the coating material. However, when the substrate is formed from a paper material, the additional water applied to the substrate exacerbates substrate curl and cockle. The coating apparatus is capable of operating over a wide range of speeds while maintaining a nearly constant rate of application.

DETAILED DESCRIPTION OF PREFERRED EMBODIMENTS

Figure 2:
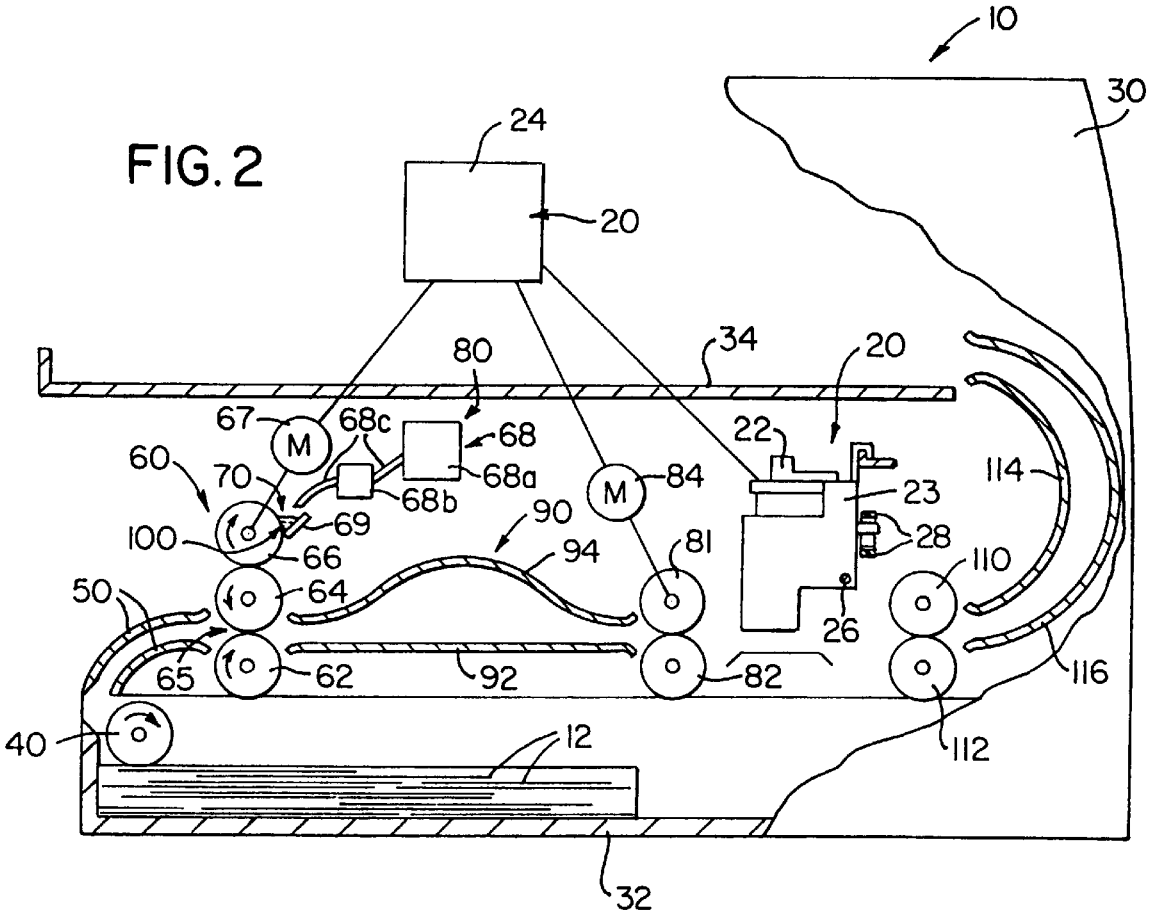
FIG. 2 is a side view, partially broken away, of an ink jet printer including the coating apparatus illustrated in FIG. 1.

A portion of an ink jet printer 10 constructed in accordance with the present invention is shown in FIG. 2. The printer 10 comprises an ink jet printer apparatus 20 located within a housing 30. The printer apparatus 20 includes an ink jet print cartridge 22 (also referred to herein as an ink jet printing device) supported in a carrier 23 which, in turn, is supported on a guide rail 26. A drive mechanism including a drive belt 28 is provided for effecting reciprocating movement of the carrier 23 and the print cartridge 22 back and forth along the guide rail 26. As the print cartridge 22 moves back and forth, it ejects ink droplets onto a printing substrate 12 provided below it. Substrates 12 capable of being printed upon by the printer 10 include commercially available plain office paper, specialty papers, envelopes, transparencies, labels, card stock and the like. A more detailed disclosure of the carrier, guide rail and drive mechanism is set out in copending patent application, U.S. Ser. No. 08/993,431, entitled "A FILTER FOR REMOVING CONTAMINANTS FROM A FLUID AND A METHOD FOR FORMING SAME," by Carl E. Sullivan, filed on Dec. 18, 1997, the disclosure of which is incorporated herein by reference.

The ink jet printer apparatus 20 further comprises a driver circuit 24. The circuit 24 provides voltage pulses to resistive heating elements (not shown) located within a printhead (not shown) forming part of the print cartridge 22. Each voltage pulse is applied to one of the heating elements to momentarily vaporize ink in contact with that heating element to form a bubble within a bubble chamber (not shown) in which the heating element is located. The function of the bubble is to displace ink within the bubble chamber such that a droplet of ink is expelled from a nozzle (not shown) associated with the bubble chamber. A more detailed discussion of the print cartridge 22 can be found in copending patent application U.S. Ser. No. 08/827,140, entitled "A PROCESS FOR JOINING A FLEXIBLE CIRCUIT TO A POLYMERIC CONTAINER AND FOR FORMING A BARRIER LAYER OVER SECTIONS OF THE FLEXIBLE CIRCUIT AND OTHER ELEMENTS USING AN ENCAPSULANT MATERIAL," filed Mar. 27, 1997, the disclosure of which is incorporated herein by reference.

The printer housing 30 includes a bottom tray 32 for storing substrates 12 to be printed upon. A rotatable feed roller 40 is mounted within the housing 30 and positioned over the tray 32. Upon being rotated by a conventional drive device (not shown), the roller 40 grips the uppermost substrate 12 and feeds it along an initial portion of a substrate feed path to a coating apparatus 60. The initial feed path portion is defined in substantial part by a pair of substrate guides 50. The coating apparatus 60, as will be discussed in more detail below, applies a layer of coating material onto at least a portion of a first side 12*a* of the substrate 12 prior to printing.

Figure 1:
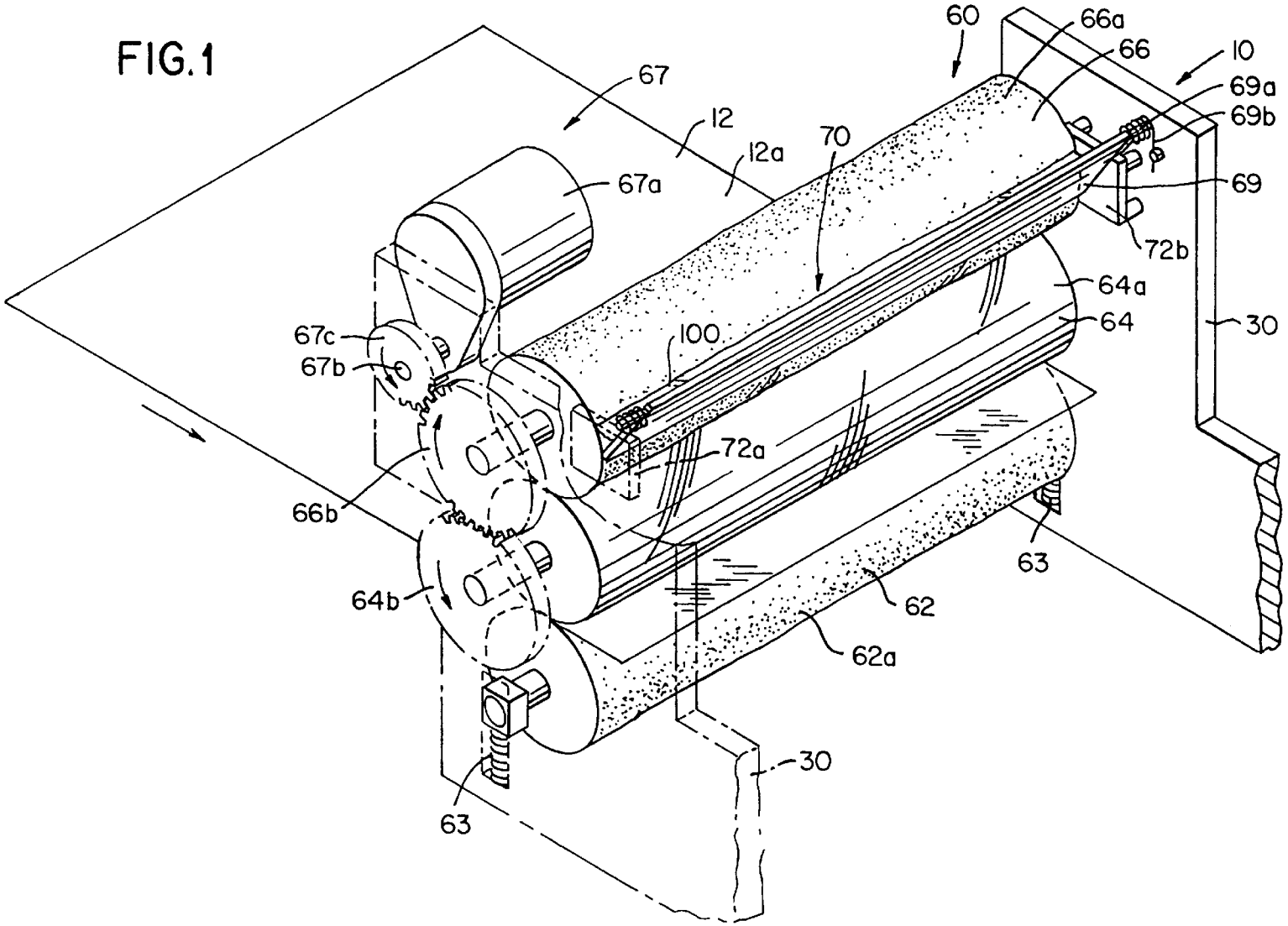
FIG. 1 is a perspective view of a coating apparatus constructed in accordance with a first embodiment of the present invention.

The coating apparatus 60 comprises rotatable first, second and third rolls 62, 64 and 66 and a metering device 68, see FIGS. 1 and 2. In the illustrated embodiment, the first roll 62 is formed from aluminum. Alternatively, the roll 62 may be formed from a polymeric material, a ceramic material or a different metal. The outer surface 62*a* of the aluminum roll 62 is grit-blasted so as to have a surface roughness of between about 1 and 4 micrometers $R_a$. After grit blasting, the aluminum roll 62 is anodized to harden the outer surface 62*a* to make it less prone to wear. The second roll 64 is mounted within the housing 30 directly above the first roll 62. Springs 63 bias the first roll 62 upwardly toward the second roll 64 so that it contacts the second roll 64. The first and second rolls 62 and 64 define a nip 65 through which the substrate 12 passes. The third roll 66 has a textured or rough outer surface 66*a* and may be made from the same material and grit blasted in essentially the same manner as the first roll 62. The third roll 66 is mounted in the housing 30 directly above and in contact with the second roll 64.

A roll drive 67 is provided comprising an electric motor 67*a* having a drive shaft 67*b*. A first gear 67*c* is mounted to the motor drive shaft 67*b* for rotation with the drive shaft 67*b*. The teeth on the first gear 67*c* engage teeth on a second gear 66*b* mounted on the third roll 66 such that rotation of the motor drive shaft 67*b* effects rotation of the third roll 66. A third gear 64*b* is coupled to the second roll 64 for rotation with the second roll 64. Teeth on the third gear 64*b* engage the teeth on the second gear 66*b* such that rotation of the second gear 66*b* and the third roll 66 effects rotation of the second roll 64. The first roll 62 is rotated by frictional contact with the second roll 64. Actuation of the roll drive 67 is effected by the driver circuit 24. Preferably, the roll drive 67 effects continuous rotation of the rolls 62, 64 and 66 during a substrate printing operation. However, the speed of rotation of the continuously moving rolls 62, 64 and 66 may vary during the printing of a substrate 12. For example, the speed of rotation may vary as a function of the rate at which the substrate 12 is fed past the print cartridge 22.

Figure 3:
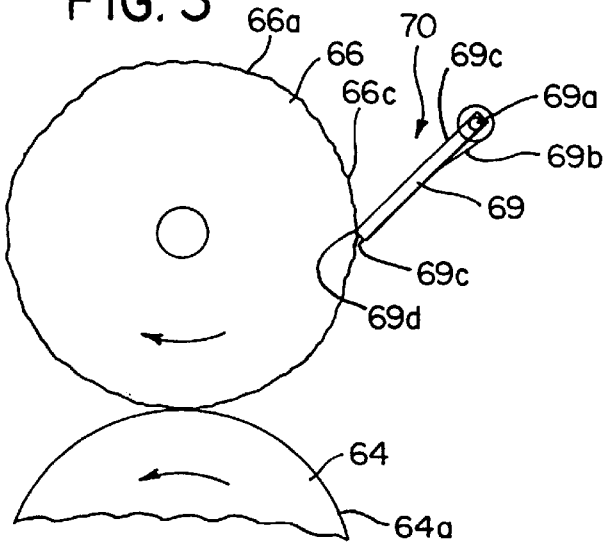
FIG. 3 is an enlarged side view of the third roller and doctor blade illustrated in FIG. 2 and taken from a first side of a printer.

The metering device 68 comprises a doctor blade 69 and a coating material supply device 80. The coating material supply device 80 is shown only in FIG. 2. The doctor blade 69 is mounted on a shaft 69*a* which, in turn, is mounted to the housing 30, see FIG. 1. A torsion spring 69*b* biases the blade 69 toward the third roll 66, see also FIG. 3. The doctor blade 69 includes a rectangularly shaped edge 69*c* and is positioned such that a corner 69*d* of the blade edge 69*c* bears on the outer surface 66*a* of the roll 66. A first side 69e of the doctor blade 69 and a portion 66*c* of the third roll 66 define a coating material receiving trough 70. First and second sealing members 72*a* and 72*b* are mounted adjacent to end portions of the third roll 66 and the doctor blade 69 so as to seal off end sections of the trough 70. Coating material 100 is provided to the trough 70 by the coating material supply device 80.

In the illustrated embodiment, the supply device 80 comprises a reservoir 68*a* containing liquid coating material 100, an electric valve 68*b* which controls the flow of coating material 100 from the reservoir 68*a* to the trough 70, conduits 68*c* which define paths for the coating material 100 to travel from the reservoir 68*a* to the trough 70 and a conventional fluid level sensor (not shown) for sensing the level of coating material 100 in the trough 70. The fluid level sensor generates fluid level signals to the driver circuit 24. Actuation of the valve 68*b* is controlled by the circuit 24 based upon the signals generated by the fluid level sensor.

As the third roll 66 rotates, its non-smooth outer surface 66*a* carries liquid coating material under the blade 69 in an amount determined primarily by the size of the depressions or valleys formed in the outer surface 66*a* of the roll 66. Because one corner 69*d* of the blade 69 contacts the roll 66 rather than a portion of the blade's first side 69*e*, the amount of coating material carried by the roll 66 under the blade 69 does not change significantly as the rotational speed of the roll 66 varies or as the load of the blade 69 against the roll 66 changes.

As the rolls 62, 64 and 66 rotate, the coating material 100 on the third roll 66 is transferred to the second roll 64. The second roll 64 then transfers the coating material to the substrate 12 passing through the nip 65. Preferably, the second roll 64 is formed from a material having a surface energy which allows the liquid coating material to sufficiently spread out on its outer surface 64*a* such that a substantially uniform layer of coating material 100 is applied by the second roll 64 to the substrate 12. The material from which the second roll 64 is formed preferably also has a sufficiently low hardness so that the second roll 64 is capable of conforming to a substantial number of valleys in the substrate 12 such that coating material 100 is transferred to those substrate valleys. Finally, the outer surface 64*a* of the second roll 64 is preferably smooth. These three factors (surface energy, material hardness and surface smoothness) are interrelated and may be varied so long as a substantially uniform layer of coating material 100 is applied to the substrate 12. In the illustrated embodiment, the second roll 64 is formed from a polyurethane, such as a polycaprolactone urethane prepolymer, which is commercially available from Uniroyal Chemical Co. under the product designation "Vibrathane 6060." The second roll 64 is ground and polished to a surface roughness of between about 14 microinches $R_a$ to about 17 microinches $R_a$.

In the illustrated embodiment, substantially the entire surface of the first side 12*a* of each substrate 12 is coated with liquid coating material 100. Preferably, between about 80 milligrams to about 120 milligrams and most preferably about 100 milligrams of coating material 100 is applied to an 8.5 inch by 11 inch substrate. It is also contemplated that only a portion of the first side 12*a* of each substrate 12, such as the portion which is to receive printed matter, may be coated.

The coating material is preferably one which is designed to speed penetration of water into the substrate 12 and fix and flocculate the ink colorant on the surface of the substrate 12, thereby improving dry time, optical density and image permanence. Example coating materials are set out in U.S. Patent Application entitled "COATING SYSTEM FOR INK JET APPLICATIONS," which has previously been incorporated herein by reference. The coating apparatus 60 is capable of applying a substantially uniform layer of coating material onto a substrate 12, wherein the coating material has a viscosity of between about 50 centipoise and about 5000 centipoise. Higher viscosity coating materials are preferred as they contain less water.

A pair of first feed rollers 81 and 82 are positioned within the housing 30 between the coating apparatus 60 and the ink jet print cartridge 22. They are incrementally driven by a conventional roller drive device 84 which is controlled by the circuit 24. The first feed rollers 81 and 82 incrementally feed the substrate 12 beneath the print cartridge 22. As noted above, the print cartridge 22 ejects ink droplets onto the substrate 12 as it moves back and forth along the guide rail 26 such that an image is printed on the substrate 12.

An intermediate substrate guide device 90 comprising a first substantially linear guide 92 and a second generally bowed guide 94 is positioned within the housing 30 along the substrate feed path between the coating apparatus 60 and the first feed rollers 81 and 82. Preferably, the circuit 24 causes the first and second rolls 62 and 64 to move continuously so as to permit the first and second rolls 62 and 64 to apply a substantially uniform layer of coating material 100 onto the substrate 12. To permit the substrate to move unrestricted through the incrementally driven first feed rollers 81 and 82, the circuit 24 also causes the first and second rolls 62 and 64 to rotate at a rotational speed sufficient such that the substrate 12 is fed at a linear speed through the rolls 62 and 64 which is greater than the speed at which the substrate 12 passes through the incrementally driven rollers 81 and 82. Due to the bowed configuration of the guide 94, the substrate 12 is permitted to buckle away from the substrate feed path as it moves out of the coating apparatus 60 and through the first feed rollers 81 and 82.

A pair of second feed rollers 110 and 112 are positioned within the housing 30 downstream from the print cartridge 22. They are incrementally driven by a conventional roller drive device (not shown) which is controlled by the circuit 24. The feed rollers 110 and 112 cause the printed substrate 12 to move through final substrate guides 114 and 116 to an output tray 34.

Figure 4:
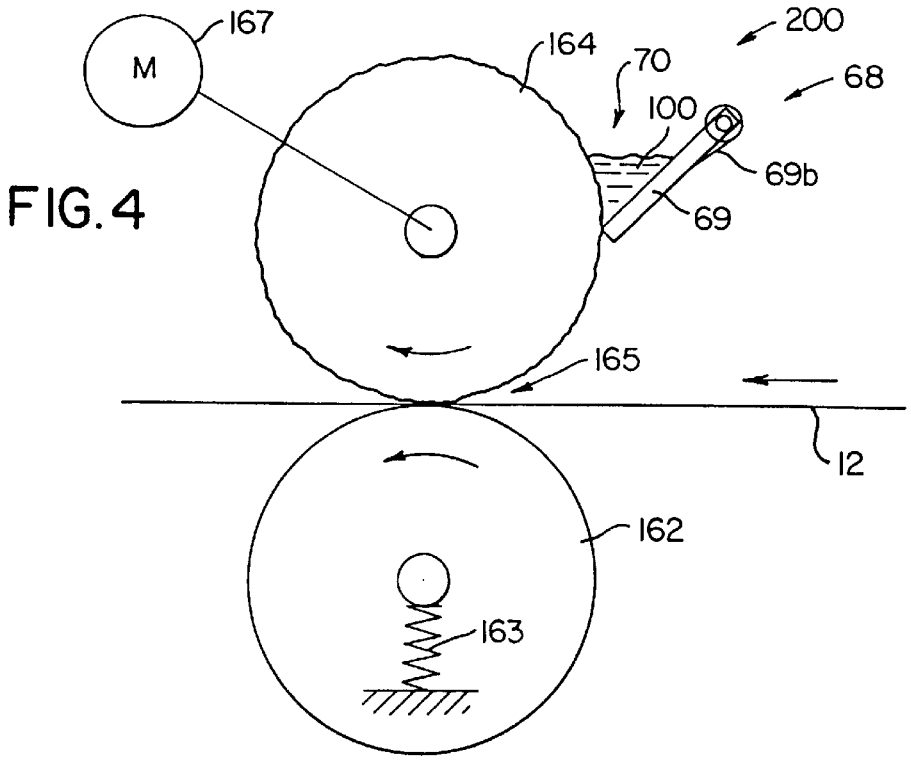
FIG. 4 is a side view of a portion of a coating apparatus constructed in accordance with a second embodiment of the present invention, wherein this view is taken from a side of a printer which is opposite to the one illustrated in FIGS. 2 and 3.

A coating apparatus 200, constructed in accordance with a second embodiment of the present invention, is shown in FIG. 4, wherein like reference numerals indicate like elements. In this embodiment, the coating apparatus 200 comprises first and second rotatable rolls 162 and 164 and a metering device 68. The metering device 68 is substantially the same as the device illustrated in FIG. 2. The coating material supply device 80 is not illustrated in FIG. 4. The first roll 162 is formed in essentially the same manner and from substantially the same material as the second roll 64 of the FIG. 1 embodiment. The second roll 164 is made from the same material and texturized in essentially the same manner as the first and third rolls 62 and 66 of the FIG. 1 embodiment.

The second roll 164 is mounted within the housing 30 directly above the first roll 162. Springs 163 bias the first roll 162 upwardly toward the second roll 164 so that it contacts the second roll 164. The first and second rolls 162 and 164 define a nip 165 through which the substrate 12 passes.

A roll drive 167 is provided for effecting rotation of the second roll 164. The first roll 162 is rotated by frictional contact with the second roll 164. Actuation of the roll drive 167 is effected by the driver circuit 24. Preferably, the roll drive 167 effects continuous rotation of the first and second rolls 162 and 164 during the printing of a single substrate 12. However, the speed of rotation of the continuously moving rolls 162 and 164 may vary during a substrate printing operation. For example, it may vary as a function of the rate at which the substrate 12 is fed past the print cartridge 22 by the rollers 81 and 82.

Figure 5:
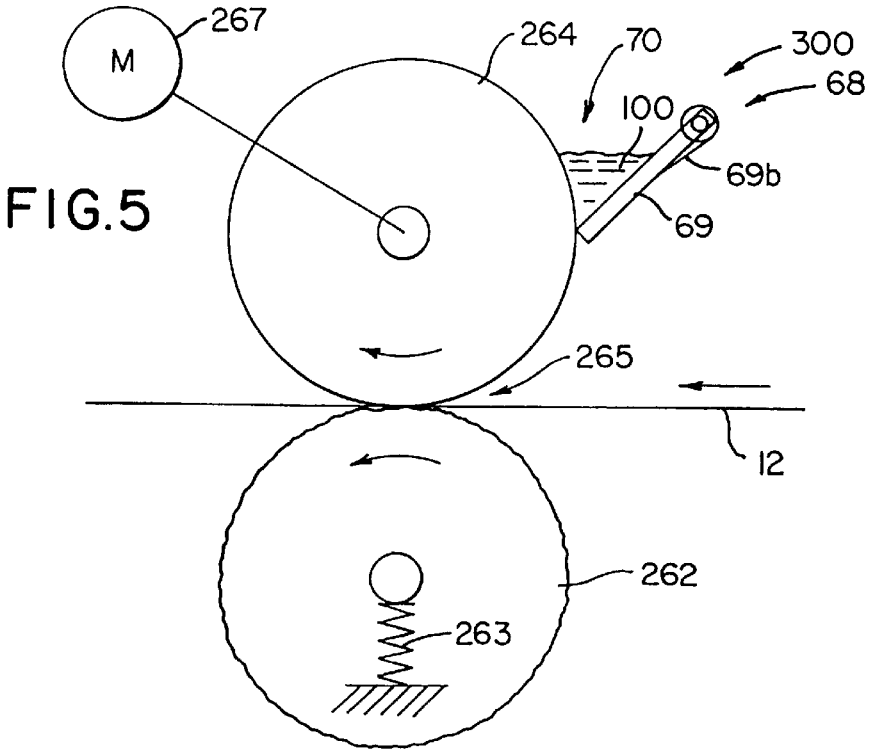
FIG. 5 is a side view of a portion of a coating apparatus constructed in accordance with a third embodiment of the present invention, wherein this view is taken from a side of a printer which is opposite to the one illustrated in FIGS. 2 and 3.

A coating apparatus 300, constructed in accordance with a third embodiment of the present invention, is shown in FIG. 5, wherein like reference numerals indicate like elements. In this embodiment, the coating apparatus 300 comprises first and second rotatable rolls 262 and 264 and a metering device 68. The metering device 68 is substantially the same as the device illustrated in FIG. 2. The coating material supply device 80 is not illustrated in FIG. 5. The first roll 262 is made from the same material and texturized in essentially the same manner as the first and third rolls 62 and 66 of the FIG. 1 embodiment. The second roll 264 is formed in essentially the same manner and from substantially the same material as the second roll 64 of the FIG. 1 embodiment.

The second roll 264 is mounted within the housing 30 directly above the first roll 262. Springs 263 bias the first roll 262 upwardly toward the second roll 264 so that it contacts the second roll 264. The first and second rolls 262 and 264 define a nip 265 through which the substrate 12 passes.

A roll drive 267 is provided for effecting rotation of the second roll 264. The first roll 262 is rotated by frictional contact with the second roll 264. Actuation of the roll drive 267 is effected by the driver circuit 24. Preferably, the roll drive 267 effects continuous rotation of the first and second rolls 262 and 264 during a substrate printing operation. However, the speed of rotation of the continuously moving rolls 262 and 264 may vary during the substrate printing operation. For example, it may vary as a function of the rate at which the substrate 12 is fed past the print cartridge 22 by the rollers 81 and 82.

It is further contemplated that the coating apparatus may be positioned downstream from the print cartridge 22. In such an embodiment, the coating apparatus applies a coating material over the ink applied to the substrate 12. It is also contemplated that a non-liquid coating material may be applied by the coating apparatus to the substrate.

What is claimed is:

1. An ink jet printer comprising:

a housing;

an ink jet printing apparatus located within said housing and including an ink jet printing device capable of ejecting ink droplets onto a first side of a printing substrate which moves through said housing along a printing substrate feed path; and a coating apparatus positioned along said printing substrate feed path and spaced from said printing device, said coating apparatus applying a substantially uniform layer of coating material onto at least a portion of said first side of said printing substrate;

wherein said coating apparatus is positioned before said ink jet printing device and comprises:

a rotatable first roll having a textured outer surface of grit-blasted aluminum;

a rotatable second roll formed from a polymeric material and positioned adjacent to said first roll and defining with said first roll a nip through which said printing substrate passes; and a metering device applying a layer of coating material onto one of said first and second rolls, which in turn transfers said coating material to said printing substrate.

2. An ink jet printer comprising:

a housing;

an ink jet printing apparatus located within said housing and including an ink jet printing device capable of ejecting ink droplets onto a first side of a printing substrate which moves through said housing along a printing substrate feed path; and a coating apparatus positioned along said printing substrate feed path and spaced from said printing device, said coating apparatus applying a substantially uniform layer of coating material onto at least a portion of said first side of said printing substrate;

wherein said coating apparatus comprises:

a rotatable first roll having a textured outer surface;

a rotatable second roll positioned adjacent to said first roll and defining with said first roll a nip through which said printing substrate passes;

a rotatable third roll having a textured outer surface positioned adjacent to said second roll; and a metering device for applying a generally uniform layer of liquid coating material onto said third roll, said third roll transferring said coating material to said second roll which in turn transfers said coating material to said printing substrate.

3. An ink jet printer as set forth in claim 2, wherein said metering device comprises:

a doctor blade in contact with said third roll such that a surface of said doctor blade and a portion of said third roll define a coating material receiving trough; and a coating material supply device for dispensing said liquid coating material to said coating material receiving trough, said doctor blade causing a generally uniform layer of said coating material to be received by said third roll as said third roll is caused to rotate.

4. An ink jet printer as set forth in claim 2, wherein said first and third rolls comprise grit-blasted aluminum rolls and said second roll is formed from a polymeric material.

5. An ink jet printer as set forth in claim 2, wherein said second roll is formed from a material having a surface energy which allows said liquid coating material to spread out sufficiently such that a substantially uniform layer of coating material is applied by said second roll to said printing substrate.

6. An ink jet printer as set forth in claim 5, wherein said material from which said second roll is formed has a sufficiently low hardness such that said second roll is capable of conforming to a substantial number of valleys in said printing substrate.

7. An ink jet printer as set forth in claim 3, wherein said doctor blade has a generally rectangularly shaped distal edge, said doctor blade being positioned such that a corner of said rectangularly shaped edge contacts said third roll.

8. An ink jet printer comprising:

a housing;

an ink jet printing apparatus located within said housing and including an ink jet printing device capable of ejecting ink droplets onto a first side of a printing substrate which moves through said housing along a printing substrate feed path;

a coating apparatus positioned along said printing substrate feed path and spaced from said printing device, said coating apparatus applying a substantially uniform layer of coating material onto at least a portion of said first side of said printing substrate; and a pair of feed rollers positioned within said housing between said coating apparatus and said ink jet printing device for incrementally feeding said printing substrate along said printing substrate feed path past said ink jet printing device.

9. An ink jet printer as set forth in claim 8, further comprising a printing substrate guide device positioned within said housing between said coating apparatus and said pair of feed rollers and having a configuration such that said printing substrate is permitted to buckle away from said printing substrate feed path as it moves out of said coating apparatus and through said pair of feed rollers.

10. An ink jet printer comprising:

a housing;

an ink jet printing apparatus located within said housing and including an ink jet printing device capable of ejecting ink droplets onto a first side of a printing substrate which moves through said housing along a printing substrate feed path; and a coating apparatus positioned along said printing substrate feed path and spaced from said printing device, said coating apparatus applying a substantially uniform layer of coating material onto at least a portion of said first side of said printing substrate;

wherein said coating apparatus comprises:

a rotatable first roll;

a rotatable second roll positioned adjacent to said first roll and defining with said first roll a nip through which said printing substrate passes;

a rotatable third roll having a textured outer surface positioned adjacent to said second roll; and a metering device for applying a generally uniform layer of liquid coating material onto said third roll, said third roll transferring said coating material to said second roll which in turn transfers said coating material to said printing substrate.

* * * * *